US007527496B2

(12) United States Patent
Lin

(10) Patent No.: US 7,527,496 B2
(45) Date of Patent: May 5, 2009

(54) SECURE TORCH

(76) Inventor: Arlo Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 576 days.

(21) Appl. No.: 11/163,261

(22) Filed: Oct. 12, 2005

(65) Prior Publication Data

US 2007/0082308 A1 Apr. 12, 2007

(51) Int. Cl.
*F23D 14/28* (2006.01)

(52) U.S. Cl. ..... 431/344; 431/153; 431/255; 431/277

(58) Field of Classification Search ..... 431/153, 431/255, 254, 277, 344, 354
See application file for complete search history.

(56) References Cited

U.S. PATENT DOCUMENTS 6,293,782 B1 * 9/2001 Tsai ..... 431/153

* cited by examiner

*Primary Examiner*—Alfred Basichas
(74) *Attorney, Agent, or Firm*—Alan Kamrath; Kamrath & Associates PA

(57) ABSTRACT

A torch includes a can. A valve is movably installed on the can between a closed position and an open position. A controlling device is movably installed on the can between a releasing position for leaving the valve in the closed position and a lifting position for lifting the valve to the open position. A mount covers the valve so that the fuel can reach the mount from the valve. A nozzle is installed on the mount so that the fuel can reach the nozzle from the mount. An igniter is installed on the can. A switch is installed on the controlling device so that the controlling device and the igniter can only be pushed through the switch after the switch is turned relative to the controlling device.

19 Claims, 11 Drawing Sheets

SECURE TORCH

BACKGROUND OF INVENTION

1. Field of Invention

The present invention relates to a secure torch.

2. Related Prior Art

Conventionally, torches are not equipped with any security elements. Children could play with the conventional torches and actuate them accidentally. Children may get burnt or set their housing on fire.

Recently, people have devised torches with security elements. The buttons for the actuation of the torches and the security elements for avoiding accidental operation of the buttons are installed on a side of the torches so that children cannot actuate the torches by operating the buttons without handling the security elements beforehand. However, as such a button and such a security element are two separate elements, children can easily observe this. Children can operate the button and the security element alternately and actuate the torch. Such designs cannot prevent children from causing damage to humans and properties.

The present invention is therefore intended to obviate or at least alleviate the problems encountered in the prior art.

SUMMARY OF INVENTION

According to the present invention, a torch includes a can. A valve is movably installed on the can between a closed position and an open position. A controlling device is movably installed on the can between a releasing position for leaving the valve in the closed position and a lifting position for lifting the valve to the open position. A mount covers the valve so that the fuel can reach the mount from the valve. A nozzle is installed on the mount so that the fuel can reach the nozzle from the mount. An igniter is installed on the can. A switch is installed on the controlling device so that the controlling device and the igniter can only be pushed through the switch after the switch is turned relative to the controlling device.

The advantage of the torch of the present invention is the security of including the switch that can be pushed only after it is turned.

Other advantages and novel features of the present invention will become more apparent from the following detailed description referring to the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
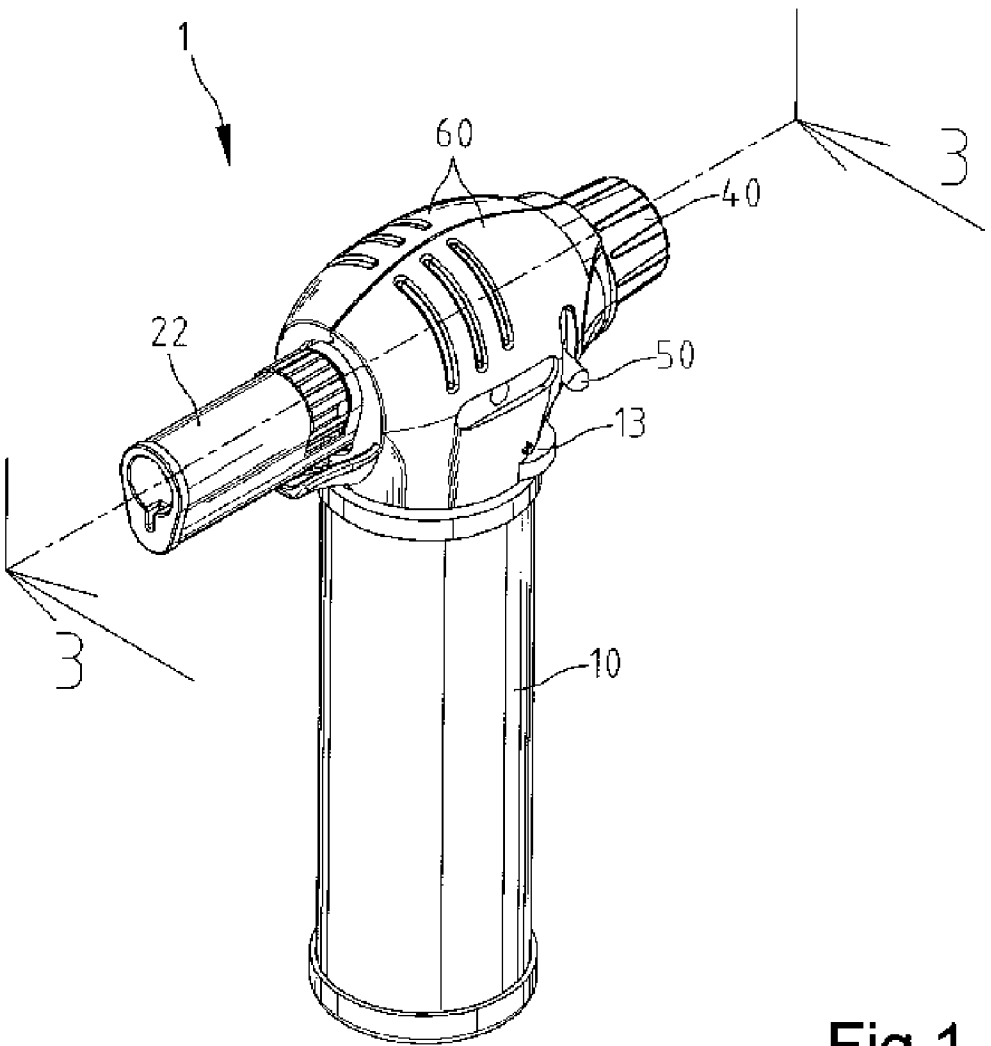
FIG. 1 is a perspective view of a torch according to the preferred embodiment of the present invention.
Figure 2:
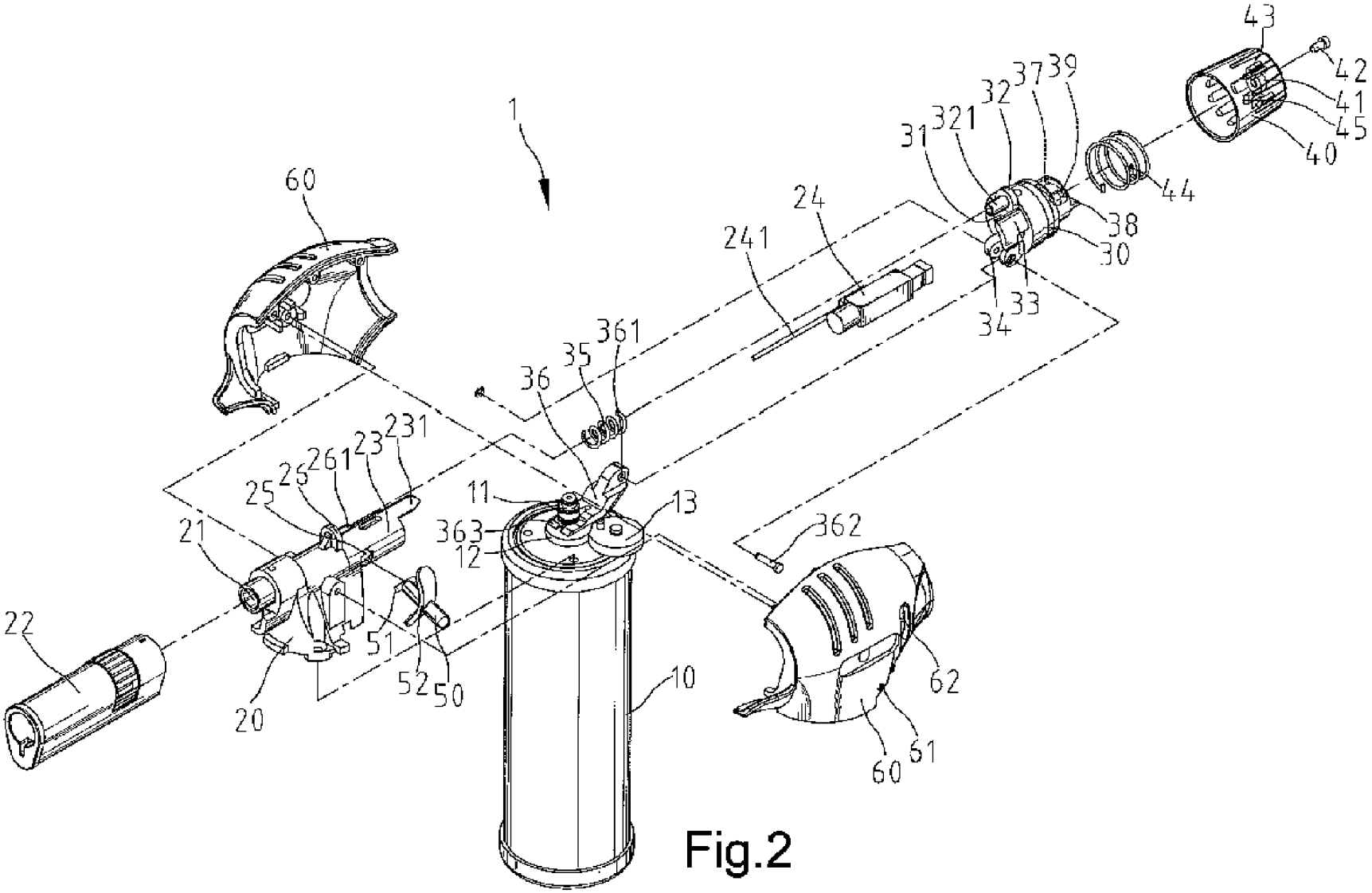
FIG. 2 is an exploded view of the torch shown in FIG. 1.
Figure 3:
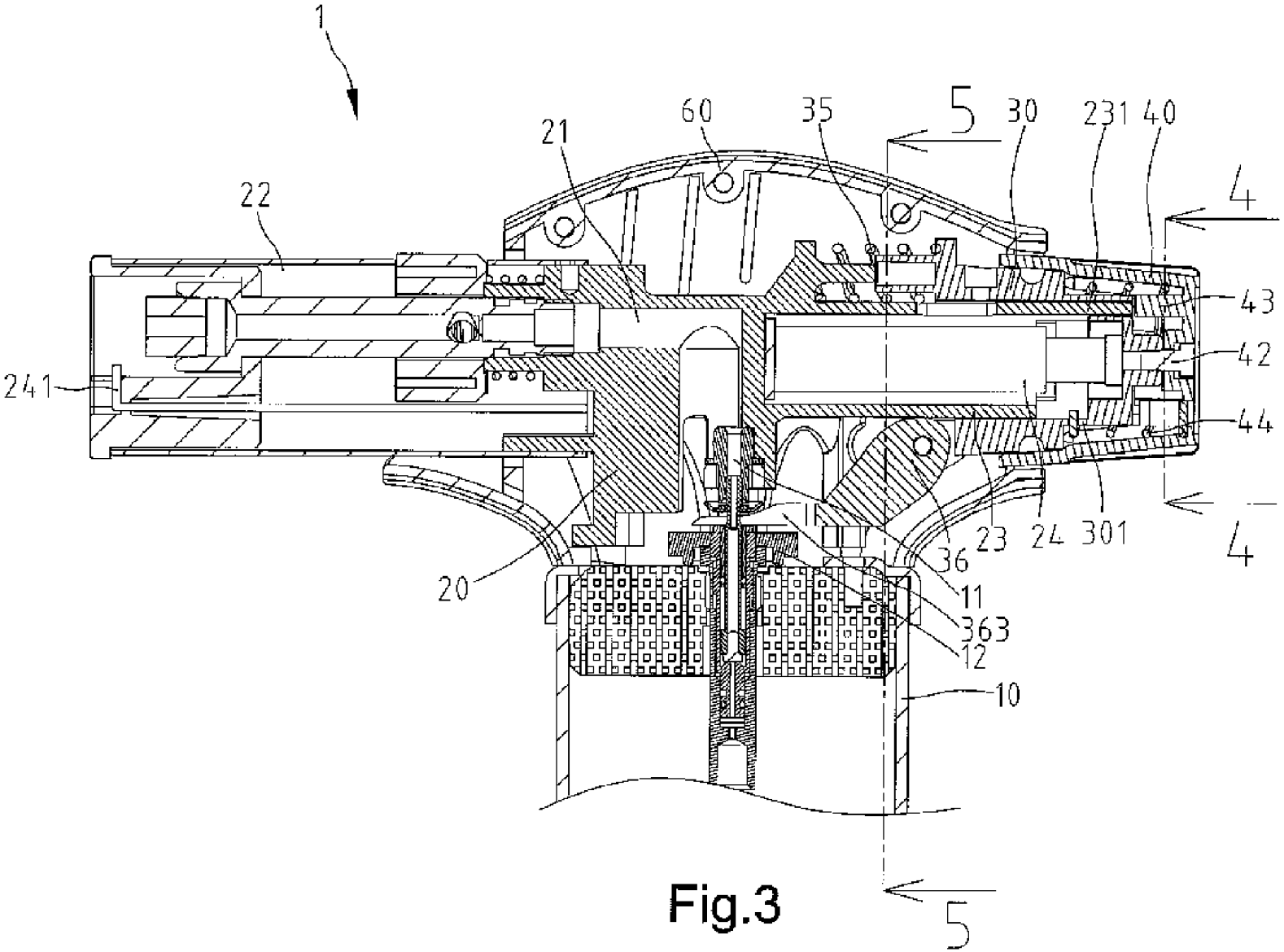
FIG. 3 is a cross-sectional view taken along a line 3-3 in FIG. 1.

Referring to FIGS. 1 through 3, there is shown a torch 1 according to the preferred embodiment of the present invention. The torch 1 includes a can 10 for storing fuel. A valve 11 is installed on the can 10. The valve 11 can be lifted in order to release the fuel. A regulator 12 is installed around the valve 11. The regulator 12 can be rotated in order to regulate the rate at which the valve 11 releases the fuel. A dial 13 is engaged with the regulator 12. The dial 13 can be rotated in order to rotate the regulator 12. To this end, the dial 13 and the regulator 12 are both in the form of a gear or a toothed wheel.

A mount 20 is installed on the can 10. On the mount 20 is formed a tube 23 defining a passageway 21. The tube 23 is in communication with the valve 11. A nozzle 22 is installed around a first section of the tube 23 while an igniter 24 is installed in a second section of the tube 23. The igniter 24 includes an electrode 241 inserted into the nozzle 22 from the tube 23. When the igniter 24 is actuated, an arc will be generated between the electrode 241 and the nozzle 22 in order to ignite the fuel spreading from the nozzle 22. A rod 231 is extended from the second section of the tube 23 longitudinally. An insert 261 is extended from a block 26 formed on the exterior of the tube 23 between the first and second sections. A recess 25 is defined in the exterior of the tube 23 near the block 26.

A controlling device includes a wedge 36, a button 30 and a spring 35. The wedge 36 includes a ramp 363 at an end and a lug 361 at an opposite end. Preferably, the ramp 363 is stepped. The ramp 363 is put beneath an enlarged portion (not numbered) of the valve 11. When the ramp 363 is pushed closer to the valve 11, the ramp 363 will lift the valve 11.

The button 30 includes two lugs 34 connected to the lug 361 by a pin 362. The button 30 includes a chamber 31 in a first end and a tunnel 37 in an opposite second end so that the tunnel 37 is in communication with the chamber 31. The chamber 31 receives the second section of the tube 23 so that the button 30 can slide smoothly on the second section of the tube 23. A sleeve 321 is extended from a block 32 formed on the periphery of the button 30. The sleeve 321 receives the insert 261 so that the button 30 will not spin about the second section of the tube 23. Between the blocks 32 and 26 is compressed the spring 35 for pushing the button 30 from the mount 20. The tunnel 37 receives the rod 231. At the second end of the button 30 is formed a stop 38 next to the tunnel 37. Centrally in the second end of the button 30 is defined a screw hole 39. At the first end of the button 30 is formed a hook 33.

A first switch 40 axially defines an aperture 41. A screw 42 is driven into the screw hole 39 through the aperture 41 so that the first switch 40 is rotationally connected to the button 30. The first switch 40 includes a rod 43 for abutting the rod 231 at the tip and for abutting the stop 38 on a side.

A torque spring 44 is provided between the button 30 and the first switch 40 for returning the first switch 40 relative to the button 30. The torque spring 44 includes an end engaged with an anchor 45 formed on the first switch 40 and another end inserted in an aperture 301 defined in the button 30.

A second switch 50 includes an axle 51 put in the recess 25 so that the second switch 50 is pivotally connected to the tube 23. A cover 52 is formed on the second switch 50.

A shell 60 consists of two identical halves. The shell 60 defines a first slot 61 of receiving the dial 13 and a second slot 62 for receiving the second switch 50. The second slot 62 will always be closed by the cover 52.

Figure 4:
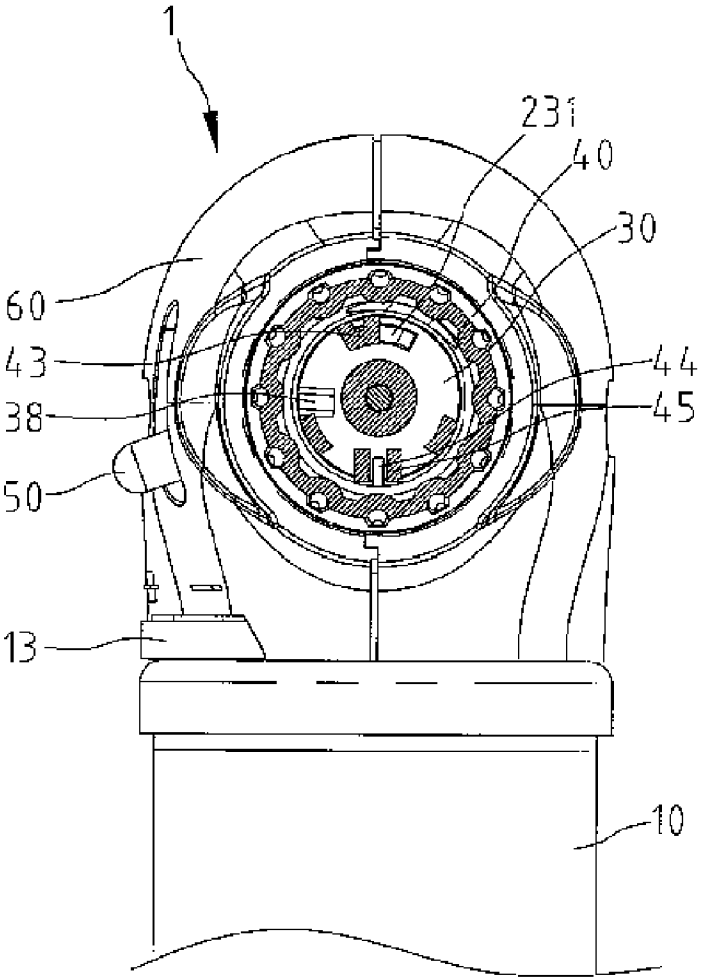
FIG. 4 is a cross-sectional view taken along a line 4-4 in FIG. 3.

Referring to FIG. 4, the first switch 40 is in its normal position where the rod 43 is aligned with the rod 231. If an attempt is made to push the button 30 through the first switch 40, the rod 231 will abut the rod 43, thus failing the attempt. The button 30 will not be pushed through the first switch 40. The igniter 24 will not be actuated. The torch 1 will not be ignited. Children will not hurt themselves and others and will not damage properties.

Figure 5:
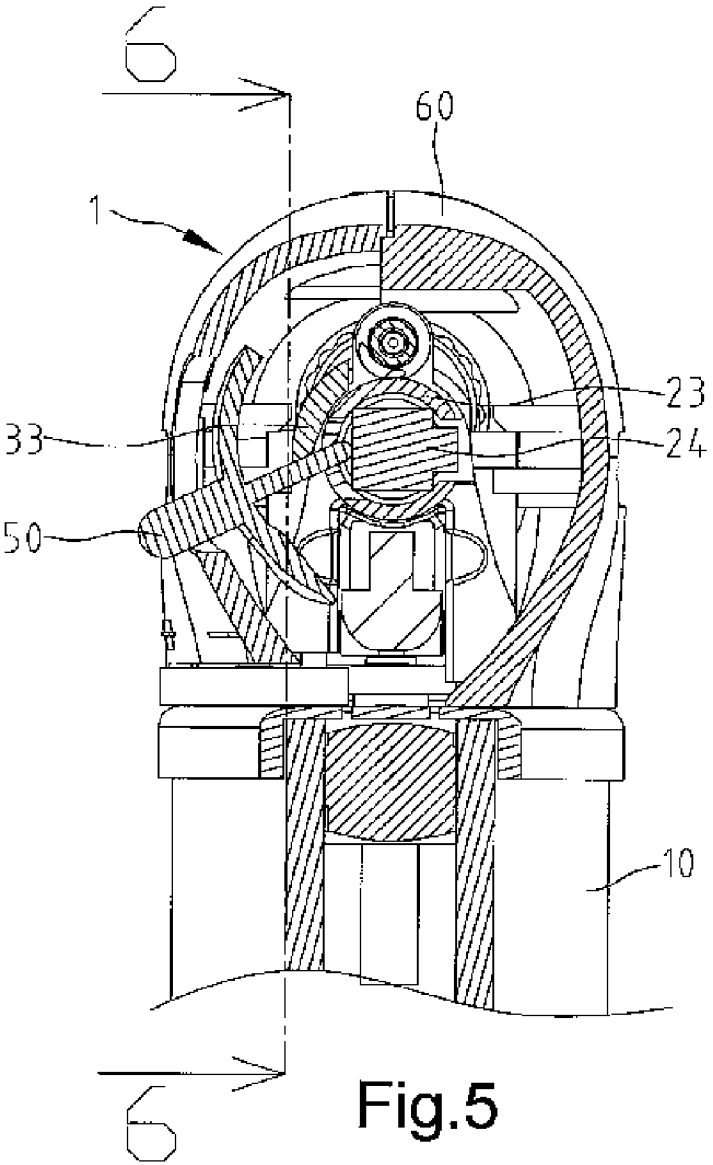
FIG. 5 is a cross-sectional view taken along a line 5-5 in FIG. 3.
Figure 6:
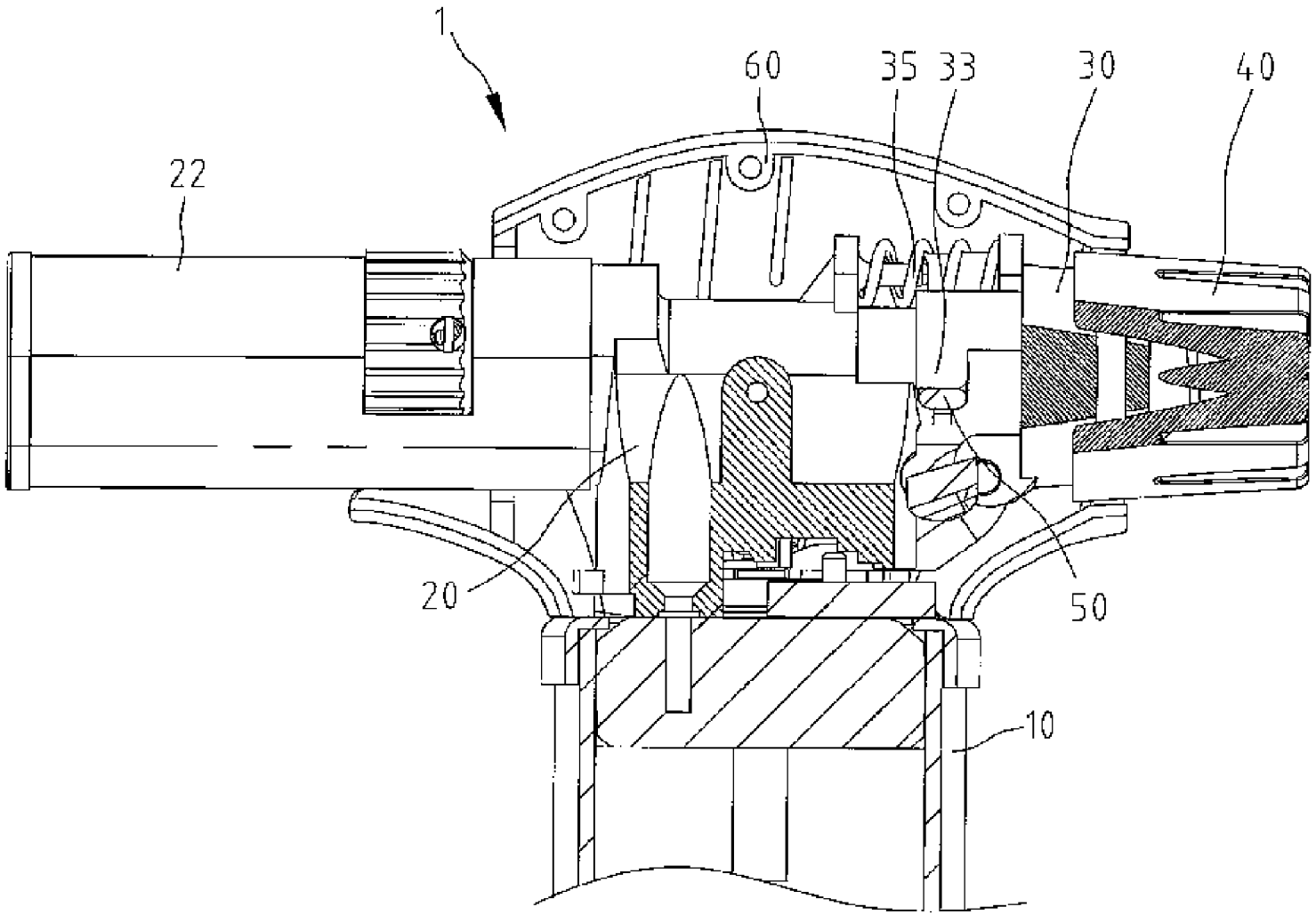
FIG. 6 is a cross-sectional view taken along a line 6-6 in FIG. 5.

Referring to FIGS. 5 and 6, the first switch 40 is in its normal position. Blocked by the hook 33, the second switch 50 cannot be operated. Children cannot do anything with the second switch 50.

Figure 7:
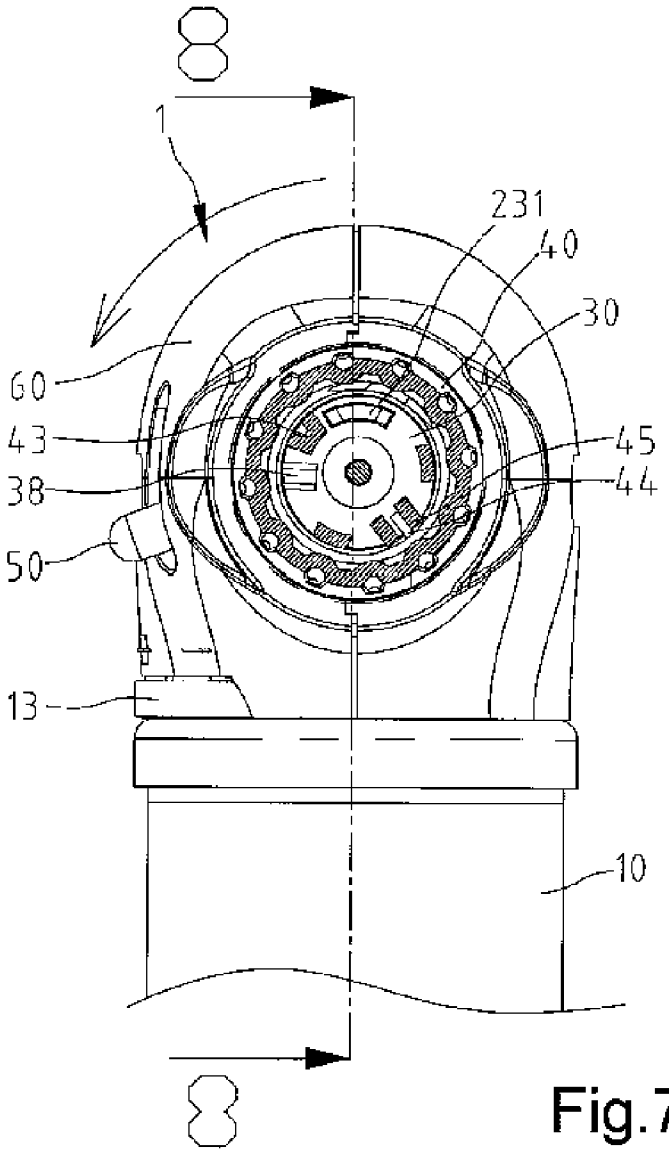
FIG. 7 is similar to FIG. 4 but shows a security element turned.
Figure 8:
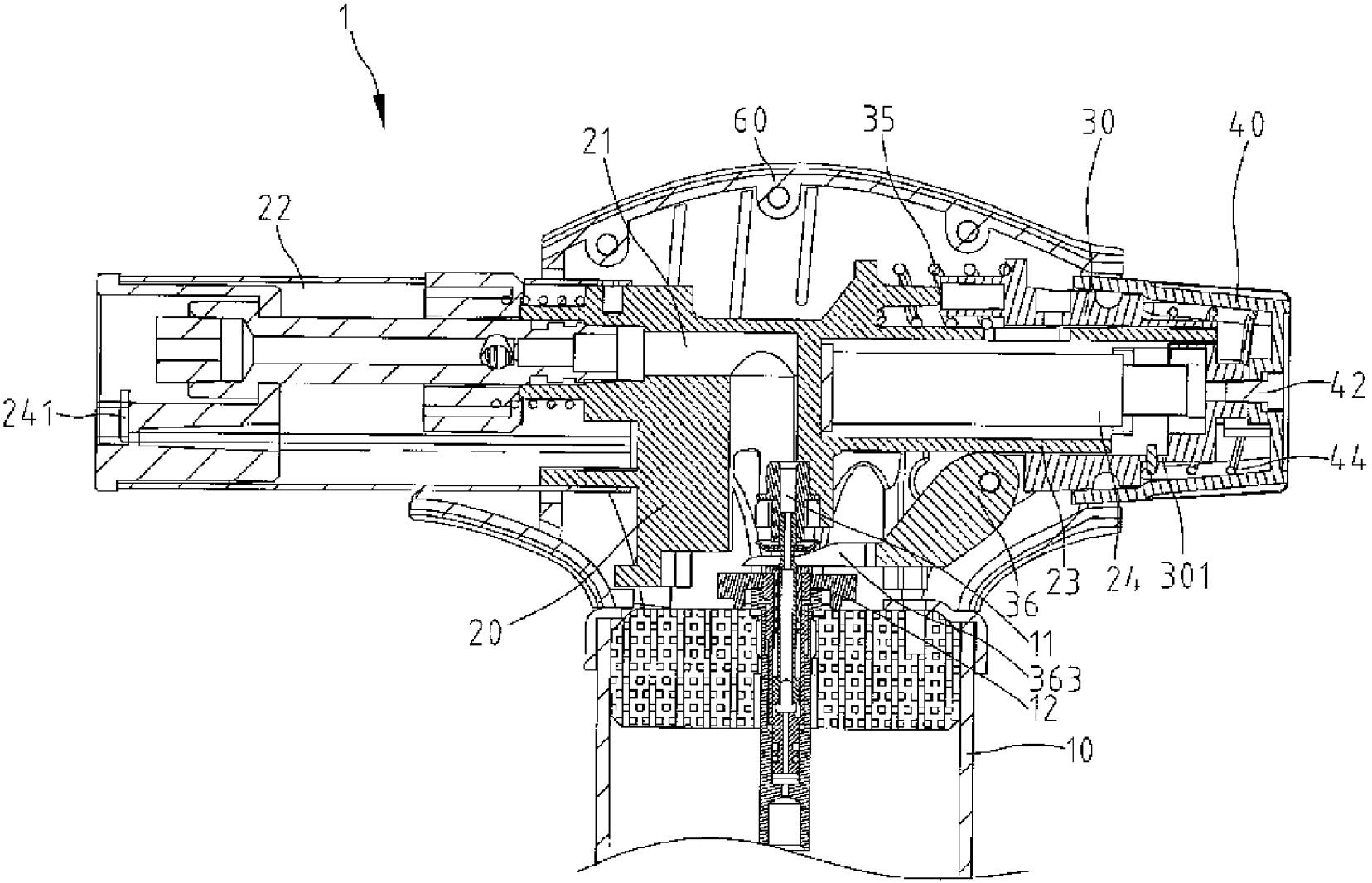
FIG. 8 is a cross-sectional view taken along a line 8-8 in FIG. 7.

Referring to FIGS. 7 and 8, the first switch 40 is turned from the normal position by an angle so that the rod 43 does not abut the rod 231 at the tip and that the rod 43 abuts the stop 38 on the side. The angle is predetermined based on the position of the stop 38.

Figure 9:
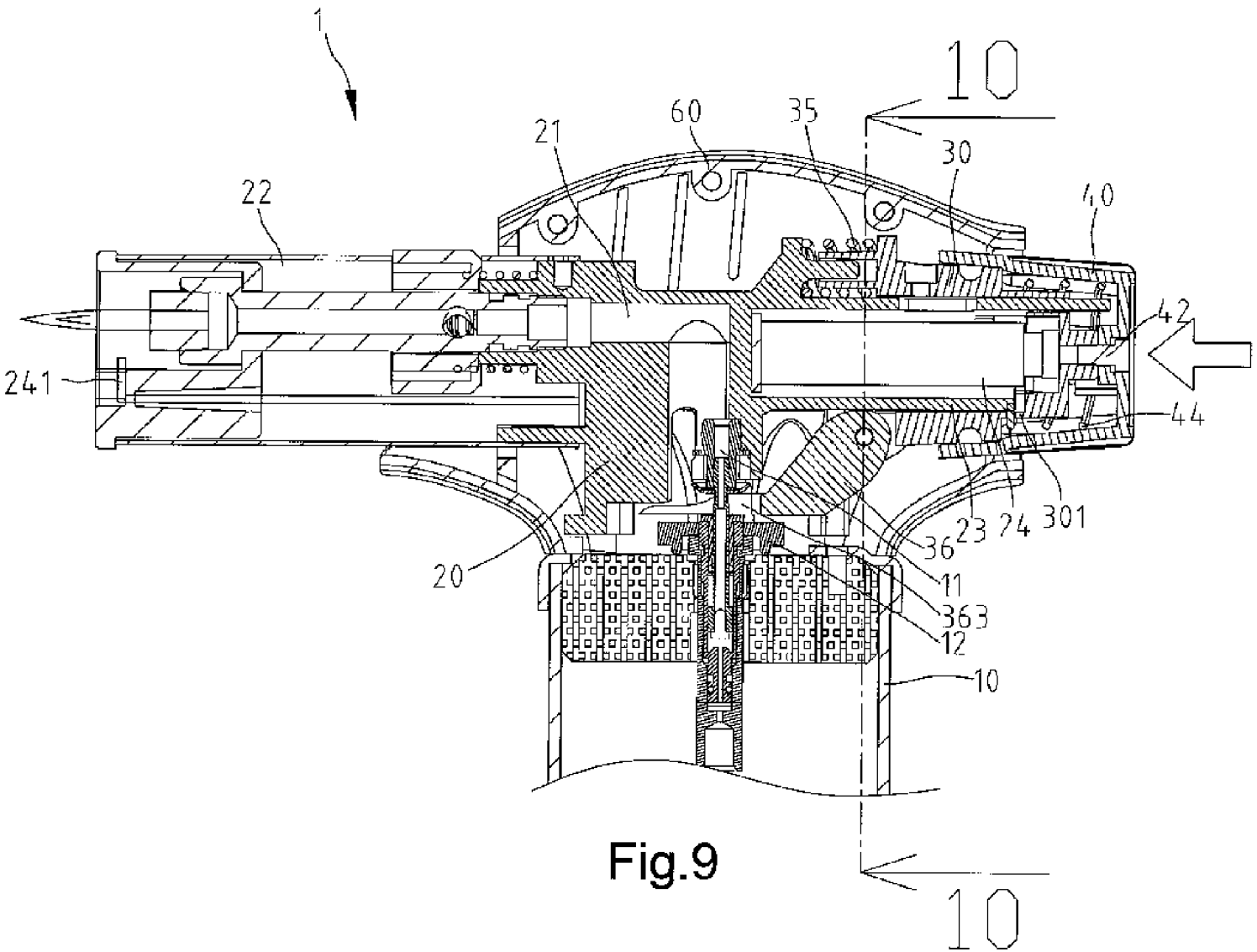
FIG. 9 is similar to FIG. 8 but shows the security element pushed.

Referring to FIG. 9, as the rod 43 does not abut the rod 231, the first switch 40 can be pushed toward the button 30. The entire controlling device is pushed. The wedge 36 is pushed toward the valve 11. The ramp 363 lifts the valve 11 in order to release the fuel from the valve 11. The fuel goes to the nozzle 22 from the tube 23. The button 30 pushes the igniter 24 in order to generate arcs between the electrode 241 and the nozzle 22. The arcs ignite the fuel.

Figure 10:
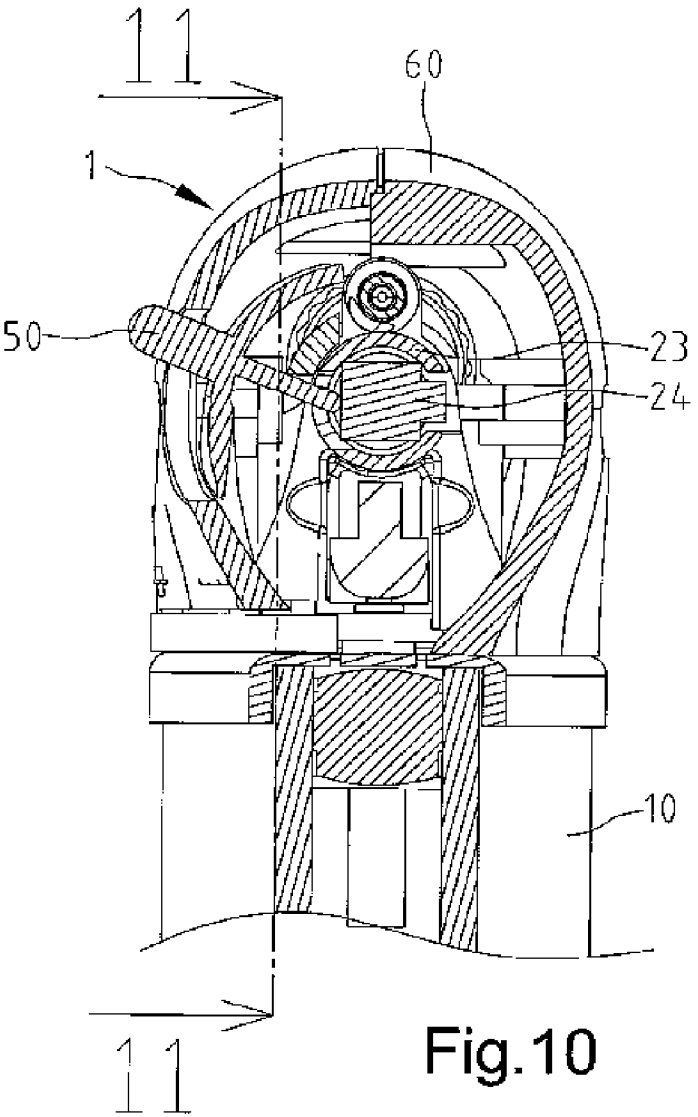
FIG. 10 is a cross-sectional view taken along a line 10-10 in FIG. 9.
Figure 11:
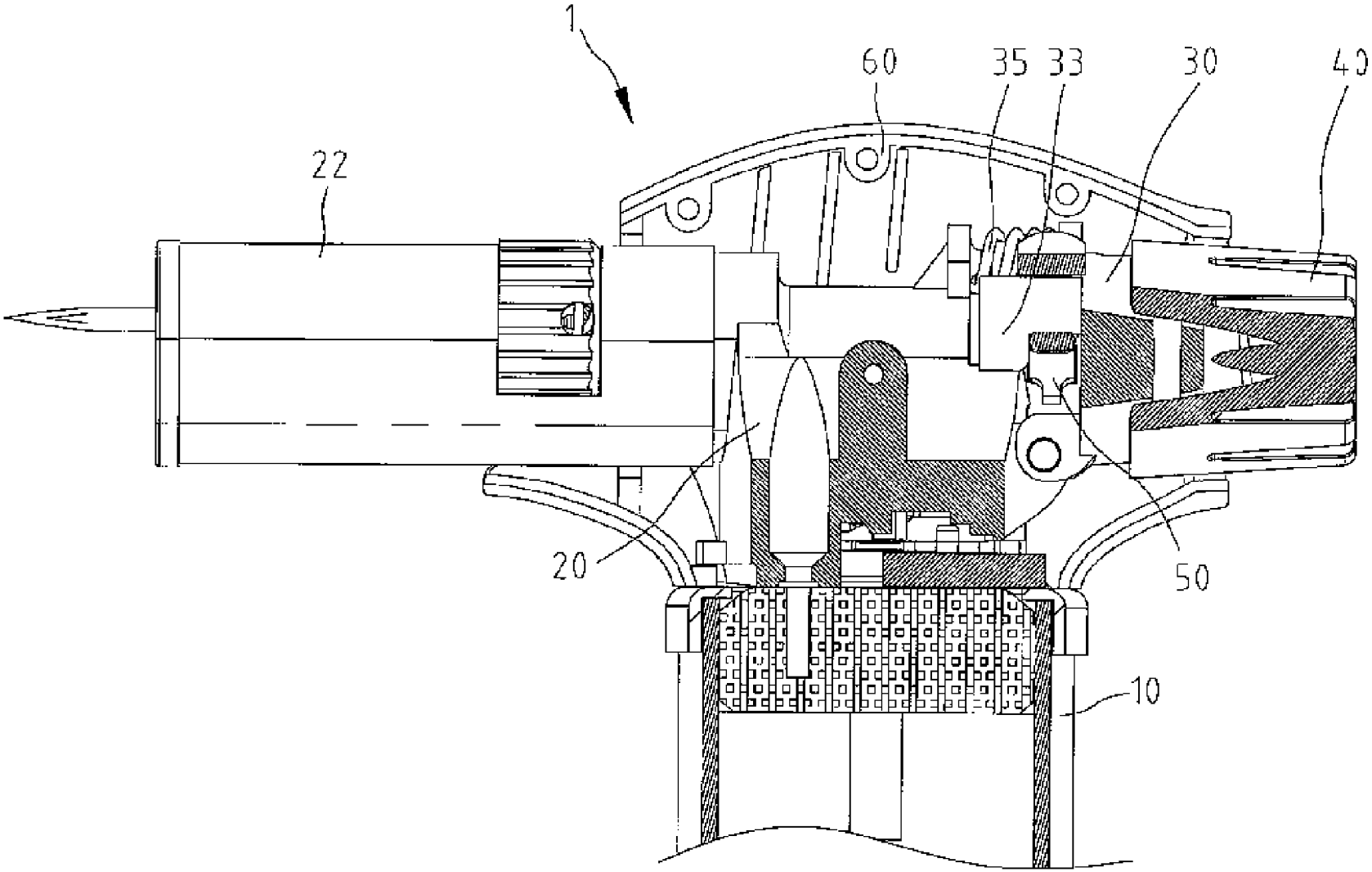
FIG. 11 is a cross-sectional view taken along a line 11-11 in FIG. 10.

Referring to FIGS. 10 and 11, the hook 33 is moved like the rest of the controlling device. The second switch 50 can be pivoted. Now, the first switch 40 can be released. The spring 35 tends to push the entire controlling device to the original position. Before the entire controlling device reaches the original position, the second switch 50 hooks the hook 33 and prevents further movement of the entire controlling device to the original position. Hence, the ramp 363 keeps the valve 11 lifted and opened. The fuel continues to reach the nozzle 22 so that the blaze continues at the nozzle 22. A user can keep the torch working in a hand-free manner.

Although the entire controlling device has not reached the original position, the button 30 has left the igniter 24 in order not to generate any arc between the electrode 241 and the nozzle 22. Hence, the electricity can be saved while the burning continues.

The torch 1 exhibits at least two advantages. Firstly, it is secure. A child cannot push the first switch 40 before turning it. Thus, accidental ignition of the fuel is avoided. A child cannot pivot the second switch 50 before pushing the first switch 40. Thus, accidental release of the fuel is avoided. Secondly, it is convenient. A user can keep it working in a hand-free manner, because the blaze continues as the fuel keeps on reaching the nozzle 22 when the user pivots the second switch 50 after pushing the first switch 40.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A torch comprising:

a can for storing fuel;

a valve movably installed on the can between a closed position and an open position;

a tube having a first section and a second section, with the tube in communication with the valve;

a controlling device movably installed on the can, with the controlling device movable relative to the tube between a releasing position for leaving the valve in the closed position and a lifting position for lifting the valve to the open position;

a nozzle on the first section of the tube in order to spray the fuel;

an igniter installed on the second section of the tube in order to ignite the fuel; and a first switch rotatably connected on the controlling device, with the first switch rotatable between a normal position and an igniting position, with the first switch in the normal position abutting with the tube and preventing relative movement of the controlling device relative to the tube with the controlling device being in the releasing position, with the first switch in the igniting position allowing movement of the controlling device into the lifting position so that the controlling device can only be pushed through the first switch after the first switch is turned from the normal position and relative to the controlling device.

2. A torch comprising:

a can for storing fuel;

a valve movably installed on the can between a closed position and an open position;

a tube having a first section and a second section, with the tube in communication with the valve;

a controlling device movably installed on the can, with the controlling device movable relative to the tube between a releasing position for leaving the valve in the closed position and a lifting position for lifting the valve to the open position;

a nozzle on the first section of the tube in order to spray the fuel;

an igniter installed on the second section of the tube in order to ignite the fuel; and a first switch rotatably connected on the controlling device, with the first switch rotatable between a normal position and an igniting position, with the first switch in the normal position abutting with the tube and preventing relative movement of the controlling device relative to the tube with the controlling device being in the releasing position, with the first switch in the igniting position allowing movement of the controlling device into the lifting position so that the controlling device can only be pushed through the first switch after the first switch is turned from the normal position and relative to the controlling device; and a second switch pivotal relative to the tube so that the second switch can only be pivoted after the controlling device is in the lifting position.

3. The torch according to claim 2 wherein the controlling device comprises a button movably installed on the tube and a wedge provided between the button and the valve.

4. The torch according to claim 3 wherein the wedge comprises a stepped ramp for lifting the valve.

5. The torch according to claim 3 wherein the button comprises a chamber for receiving the tube.

6. The torch according to claim 3 further comprising a rod extending from an end of the tube, wherein the button comprises a tunnel for receiving the rod, wherein the first switch comprises a rod portion abutting the rod of the tube when the first switch is in the normal position so that the first switch cannot be pushed against the button, with the rod portion not abutting with the rod and inserted into the tunnel when the first switch is turned from the normal position so that the first switch can be pushed against the button.

7. The torch according to claim 6 wherein the button comprises a stop formed thereon in order to stop the rod portion of the first switch.

8. The torch according to claim 3 further comprising a torque spring provided between the button and the first switch for returning the first switch to the normal position.

9. The torch according to claim 3 wherein the button comprises at least one lug, wherein the wedge comprises at least one lug connected to the lug of the button.

10. The torch according to claim 3 wherein the controlling device further comprises a pin for joining the lug of the button to the lug of the wedge.

11. The torch according to claim 3 wherein the controlling device further comprises a pin for joining the lug of the button to the lug of the wedge.

12. The torch according to claim 11 wherein the tube comprises a recess defined in the external side, wherein the second switch comprises an axle formed at an end and put in the recess so that the second switch is pivotally connected to the tube about the axle.

13. The torch according to claim 12 wherein the button comprises a hook for hindering the second switch when the button is not pushed by the first switch and for hooking the second switch when the button is pushed by the first switch, thus keeping the valve in the lifted position.

14. The torch according to claim 3 further comprising a compression spring between the tube and the button.

15. The torch according to claim 13 wherein the tube comprises a block formed thereon, wherein the button comprises a block formed thereon, wherein the compression spring is provided between the blocks of the tube and the button.

16. The torch according to claim 3 wherein the tube comprises an insert formed thereon, wherein the button comprises a sleeve formed thereon receiving the insert so that the button will not spin around the tube.

17. The torch according to claim 2 wherein the igniter comprises an electrode extended into the nozzle.

18. The torch according to claim 2 further comprising a regulator operable to regulate the rate at which the valve releases the fuel.

19. The torch according to claim 2 further comprising a shell for covering the valve, the controlling device, the tube and the igniter.

* * * * *